US005085188A

United States Patent [19]

Gasparri et al.

[11] Patent Number: 5,085,188

[45] Date of Patent: Feb. 4, 1992

[54] MODULAR LUBRICATION/FILTER SYSTEM

[75] Inventors: James A. Gasparri, North Providence; Joseph A. Borgia, Cranston; Paul C. Randall, Warwick; Edmond H. Cote, Jr., Warren; Anthony J. Caronia, East Greenwich, all of R.I.

[73] Assignee: Allied-Signal Inc., Morristown, N.J.

[21] Appl. No.: 622,886

[22] Filed: Dec. 3, 1990

[51] Int. Cl.[5] ..... F01M 11/03

[52] U.S. Cl. ..... 123/196 R; 123/196 A; 184/6.21; 184/1.5

[58] Field of Search ..... 123/196 R, 196 A; 184/6.21, 6.24, 1.5; 210/456, 168, DIG. 13

[56] References Cited

U.S. PATENT DOCUMENTS

| | | | |
|---|---|---|---|
| 1,384,873 | 7/1921 | Strickland | 184/27.2 |
| 2,426,817 | 9/1947 | Charlton et al. | 210/168 |
| 2,453,217 | 11/1948 | Gregg et al. | 184/6.13 |
| 2,976,686 | 3/1961 | Ford | 123/196 A |
| 3,539,009 | 11/1970 | Kudlaty | 210/90 |
| 3,763,960 | 10/1973 | John | 184/6.13 |
| 3,845,751 | 11/1974 | Runstetler | 123/196 A |
| 4,036,775 | 7/1977 | Dahm et al. | 210/DIG. 13 |
| 4,075,099 | 2/1978 | Pelton et al. | 210/168 |
| 4,151,823 | 5/1979 | Grosse, et al. | 123/196.19 |
| 4,217,221 | 8/1980 | Masso | 210/168 |
| 4,245,593 | 1/1981 | Stein | 123/196 AB |
| 4,449,493 | 5/1984 | Kopec et al. | 123/196 A |
| 4,492,632 | 1/1985 | Mattson | 210/168 |
| 4,648,363 | 3/1987 | Kronich | 184/6.24 |
| 4,674,457 | 6/1987 | Berger et al. | 123/196 R |
| 4,683,850 | 8/1987 | Bauder | 123/196 R |
| 4,724,806 | 2/1988 | Hartwig | 123/196 A |
| 4,997,556 | 3/1991 | Yano et al. | 210/DIG. 13 |

FOREIGN PATENT DOCUMENTS

| | | | |
|---|---|---|---|
| 2812331 | 9/1979 | Fed. Rep. of Germany | 210/168 |

*Primary Examiner*—E. Rollins Cross
*Assistant Examiner*—Erick Solis
*Attorney, Agent, or Firm*—Ken C. Decker; William N. Antonis

[57] ABSTRACT

A lubrication system for an internal combustion engine used to power an automotive vehicle includes a housing separate from the engine, and a lubricating oil transfer circuit which pumps oil from the engine to the housing and from the housing back to the engine, and a recycle circuit which pumps oil from a common sump to which the transfer circuit is connected through a filter element and back into the sump.

19 Claims, 1 Drawing Sheet

MODULAR LUBRICATION/FILTER SYSTEM

Figures 1, 2:
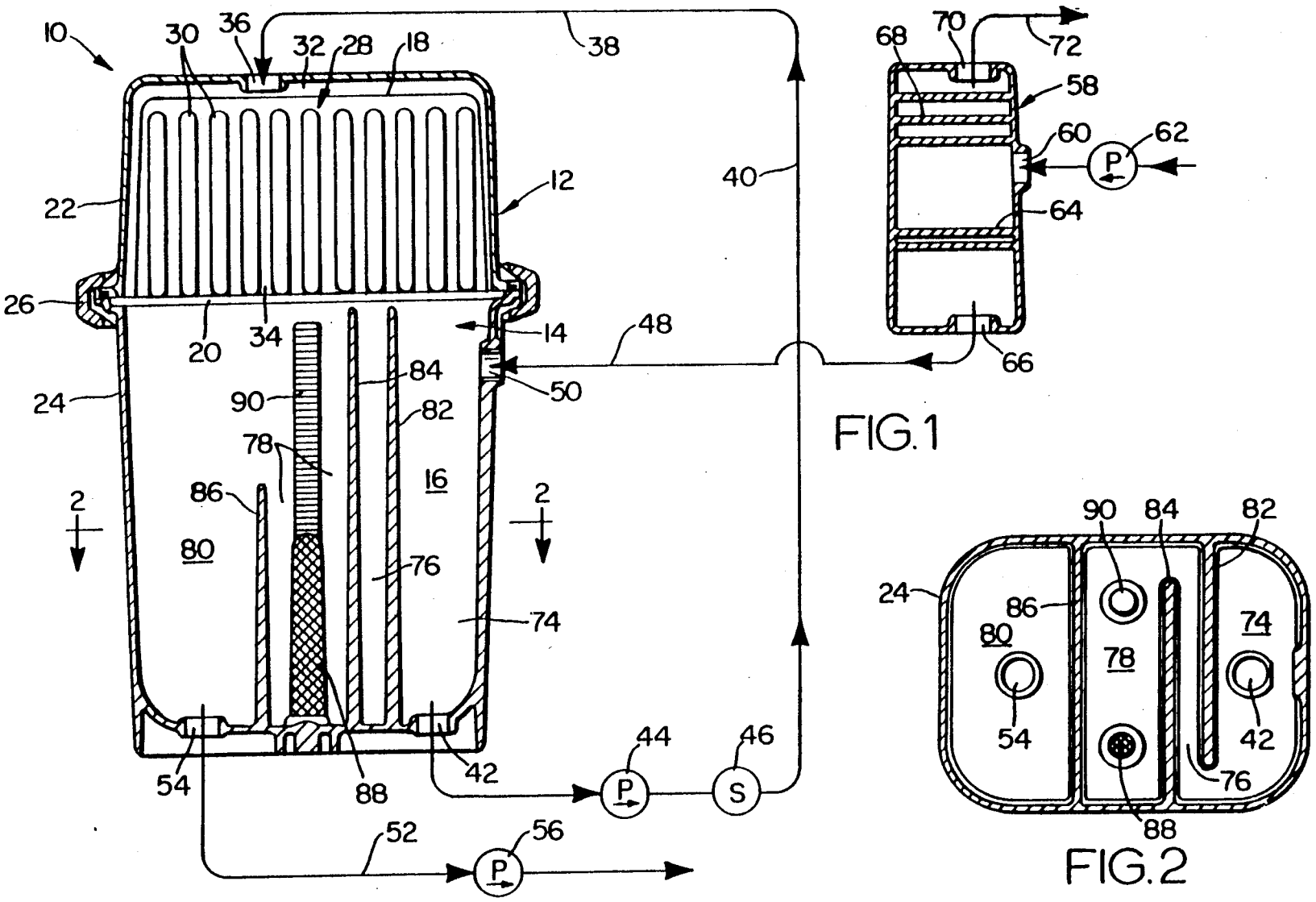

This invention relates to a lubrication system for an internal combustion engine used to operate an automotive vehicle.

Existing automotive vehicles are equipped with an internal combustion engine in which the engine lubricating oil is collected in the crankcase and pumped back into the oil galleries by an oil pump. The oil pump must generate sufficient pressure to overcome the restriction caused by the oil filter which removes particulate contaminants from the lubricating oil and still maintain sufficient pressure to assure proper lubrication to the engine bearings. As the filter is used, the restriction across the filter increases, so that the oil supplied to the engine is diminished. Furthermore, the oil must be periodically drained from the crankcase and disposed of. Oftentimes, the oil is not properly disposed of and may, if not disposed of properly, pose an environmental contamination hazard. Similarly, used oil filters are often disposed of in landfills, where they may also pose environmental contamination problems Furthermore, it is desirable to "prelube" the engine before starting by supplying oil to the lubrication surfaces. Existing automobiles equipped with fuel injection systems start so quickly that engine cranking is minimized, so that oil does not have a chance to reach critical surfaces which should be lubricated at all times when the engine is running to assure maximum engine life. Furthermore, the crankcase on existing internal combustion engines must be of a depth sufficient to collect the oil used to lubricate the engine. This adds several inches to the engine height, thereby complicating the designers' efforts to assure minimum air resistance by streamlining the vehicle.

The present invention provides a separate lubrication unit mounted remote from the engine. The lubrication unit includes a housing which is divided into a sump section and a filtering section. A lubrication oil transfer circuit pumps engine lubricating oil from the engine to the sump section and from the sump section back to the engine. A separate recycling circuit includes a pump which pumps oil from the sump section to the filter section, where it is filtered and then returned to the sump section. Since the lubrication unit may be located virtually anywhere on the vehicle, engine height is reduced and the vehicle can be designed to be more streamlined. Furthermore, since the filter is not a part of the primary circuit which transfers lubricating oil to and from the engine, the restriction within the system does not change as the filter get dirty, and the restriction of the filter is no longer in the lubrication system, so that the restriction of the filter does not have to be overcome so that the pressure of the oil to the engine can be reduced This simplifies sealing, and achieves easier engine maintenance. Furthermore, the pump which pumps lubricating oil from the sump to the engine can be started when the vehicle ignition is turned on, thereby immediately supplying lubricating oil to critical lubrication surfaces before the engine is started. Still further, the sump and filter are a completely self-contained unit which can be easily changed and replaced with a new unit. The selfcontained unit may then be sent to a central location for proper recycling of the oil, the filter, and the lubrication unit itself, thereby assuring that environmental contamination will not occur due to oil spills, improper disposal, etc.

These and other advantages of the present invention will be apparent from the following description, with reference to the accompanying drawings, in which:

FIG. 1 is a schematic illustration of an engine lubrication system made pursuant to the present invention, with some of the major components used therein illustrated in cross-section; and FIG. 2 is a cross-sectional view taken substantially along line 2—2 of FIG. 1.

Referring now to the drawings, a lubrication system generally indicated by the numeral 10 includes a lubrication oil supply housing generally indicated by the numeral 12. The housing 12 is designed to receive lubricating oil from, and to supply lubricating oil to, the vehicle internal combustion engine, but is designed to be mounted separate from the engine. The housing 12 may be mounted in the vehicle engine compartment, or in any other convenient location within the vehicle, even if such a location is outside the engine compartment The housing 12 defines a chamber 14 therewithin, which is divided into a sump section 16 and filtering section 18 by porous member 20. The housing 12 is divided at the porous member 20 into an upper portion 22 which defines the filtering section 18 and a lower portion 24, which defines the sump section 16 therewithin. The upper section 22 and the lower section 24 are clamped together with the porous member 20 by conventional, circumferentially extending clamping ring 26. The clamping ring 26 is designed to be removed only at an approved service center, which has the facilities for properly recycling and/or otherwise disposing of the lubricating oil and filter contained within the chamber 14. A conventional filter element generally indicated by the numeral 28 is located within the filtering section 18 and consists of an array of pleats 30. The filter element 28 is manufactured of a conventional filtering media well known to those skilled in the art, such as pleated paper or a pleated nonwoven filtering media. The element 28 divides the filtering section 18 into an pressurized side 32 and a return side 34, which is communicated with the sump section 16 through the porous member 20.

The pressure side 32 is communicated through an inlet opening 36 to a recycle fluid circuit generally indicated by the numeral 38 consisting of a conduit illustrated schematically as at 40 which communicates the inlet opening 36 with an outlet opening 42 at the very bottom of the sump section 16. The recycle circuit 38 further includes a pump 44, the inlet or suction side of which is connected to the outlet opening 42 and the pressure or outlet side of which is communicated to the inlet opening 36. The pump 44 is designed to maintain a pressure in the pressure side 18 which renders the filter 28 most efficient in filtering the lubricating oil communicated into the pressure side 18. This pressure level is relatively low when the filter element 28 is new, but can increase substantially as the filter element 28 is used. Accordingly, a pressure level can be maintained in the pressure side 18 which is greater than the maximum pressure level that is maintained across conventional filters in the lubricating oil systems of existing internal combustion engines. The filter element 28 can filter effectively at pressures greater than these conventional pressures, and the pump 44 is capable of generating these higher pressures. The filter element 28 lasts longer than conventional filters used in the lubricating systems of internal combustion engines, since the pressure in existing internal combustion engines must be limited so that proper sealing can be maintained and proper lubricating pressure to the surfaces requiring lubrication can also be maintained. A pressure switch 46 is connected between the outlet of the pump 44 on the pressure side 18, and is effective to shut-off the pump 44 when the pressure level in the pressure side 18 exceeds some predetermined maximum, which is indicative of a clogged filter element condition.

Lubricating oil is transferred between the internal combustion engine and the housing 12 by a transfer circuit consisting of an inlet conduit 48 which communicates lubricating oil into an inlet opening 50 and a return conduit 52 which communicates oil from the sump section 16 through an outlet opening 54. A return transfer pump 56 draws lubricating oil through the outlet opening 54 and pumps the oil back to the engine. The pump 56, since it does not have to overcome the resistance of an oil filter, can maintain a relatively low oil pressure, thus permitting the engine to use relatively simpler and less expensive oil seals than those now commonly used.

Lubricating oil communicated through inlet conduit 48 from the internal combustion engine passes through a deaeration unit generally indicated by the numeral 58. Lubricating oil is pumped from the engine into inlet opening 60 of the deaeration unit 58 by an inlet transfer pump 62 which forces lubricating oil through the inlet conduit 48 from a relatively small crankcase (not shown) on the engine which is only large enough to collect the oil dropping from the engine bearings. Oil communicated through the inlet 60 passes through a porous member 64 which serves as a deaeration screen. Porous member 64 separates the air from the oil communicated through the deaeration unit 58. The oil passes out of the deaeration unit 58 though outlet opening 66, which is communicated directly with inlet opening 50. The air separated from the oil by the screen or porous member 64 passes through a set of baffles generally indicated by the numeral 68 and is vented back to the top of the engine through vent port 70 and vent line 72.

The sump 16 is subdivided into compartments 74, 76, 78, and 80 by a series of baffles 82, 84 and 86. It will be noted that the baffles 82 and 84 extend only part way across the sump 16 while, although the baffle 86 extends all the way across the sump 16, the height of the baffle 86 is only about ½ the height of the sump. It will also be noted that the outlet opening 42 for the recycle circuit 38 is communicated in the common compartment 74 with the inlet opening 50 from the inlet conduit 48, while the outlet opening 54 to which the outlet conduit 52 is communicated communicates from the compartment 80 at the opposite side of the housing 12 from the compartment 74. Accordingly, in order for the dirty oil communicated through inlet opening 50 to travel directly to the outlet opening 54 without passing through the recycle circuit 38, the dirty oil would have to pass around the baffles 82 and 84 and over the baffle 86. Since the outlet opening 42 and inlet opening 50 communicate with the same chamber 74, the dirty oil will probably be pumped through the recycle circuit 38 in the filter element 28 at least once before passing through the outlet opening 54, assuring that particulate contaminants entrained within the dirty oil will be removed by the filter element 28.

An electrical resistance heater element 88 of conventional design projects into the sump 16 and is connected to the vehicle electrical system (not shown) for automatically heating the oil 16, thus facilitating engine start-up and warm-up during cold weather conditions. An oil level sensor indicated schematically at 90, also of conventional design, generates an electrical signal whenever the oil level in the sump 16 drops below a predetermined level. The oil level sensor 90 may be connected to a warning light on the vehicle dashboard, to thus provide a visual indication to the vehicle operator whenever the oil level drops below a predetermined level. It will also be noted that, since the filter 18 is in a entirely separate recycle circuit 38 from the transfer circuit consisting of conduits 48 and 52, that no bypass around the filter element 28 is necessary It will also be noted that, although the inlet and outlet openings 36, 42, 50 and 54 are illustrated as simple openings, they would preferably be provided with a conventional dry brake connectors (not shown), so that the housing 12 may be disconnected from the vehicle without loss of oil when an oil change is necessary. Accordingly, oil changes can be accomplished within a few seconds by unskilled labor by merely disconnecting the old housing 12 and installing a new one. The housings containing used oil and filter element may then be sent to a central recycling station, which is equipped to properly dispose of the used motor oil and used filter element. The housing 12 can then be cleaned, and a new filter element and motor oil can be installed, and the unit sent back to a oil change station for installation in another vehicle.

We claim:

1. Lubrication system for internal combustion engine comprising a housing separate from said engine, said housing defining a chamber therewithin, means dividing said chamber into a filtering section and a sump section, a filter element for filtering engine lubricating oil mounted in said filtering section, conduit means for communicating lubricating oil from said engine to said sump section and from said sump section to said engine, transfer pump means for pumping lubricating oil from said engine to said sump section and from said sump section to said engine through the conduit means, and recycling pump means separate from said transfer pump means for pumping oil from said sump section to said filtering section, said lubricating oil being returned to said sump section after passing through the filter element, said recycling pump means having an inlet side communicated to said sump section and an outlet side communicated to said filtering section whereby said lubricating oil is pumped from said sump section into said filtering section for filtering by said filter element before being returned to said sump section.

2. Lubricating system as claimed in claim 1, wherein said sump section includes an inlet connected to said conduit means for receiving oil communicated to said sump section from said engine and an outlet connected to said conduit means for returning oil to said engine, and baffles within said sump section defining a circuitous path between the inlet and the outlet to impede flow of the lubricating oil directly from the inlet to the outlet.

3. Lubricating system as claimed in claim 2, wherein said baffles at least partially divide said sump section into compartments while permitting communication from each compartment to an adjacent compartment around and/or over the baffle separating said compartments, said inlet and the inlet side of said recycling pump means being communicated to a common compartment, said outlet being communicated to a compartment other than said common compartment.

4. Lubricating system as claimed in claim 3, wherein said filter element divides said filtering section between a pressurized side communicated with the outlet side of the recycling pump and a return side communicated with the sump section.

5. Lubricating system as claimed in claim 4, wherein said means dividing said chamber into a sump section and a filtering section is a porous member extending across said housing transversely with respect to said baffles.

6. Lubricating system as claimed in claim 1, wherein said sump section includes a level sensing means for measuring the quantity of lubricating oil in said sump.

7. Lubricating system as claimed in claim 1, wherein said sump section includes a heating element for heating the lubricating oil in said sump.

8. Lubricating system as claimed in claim 1, wherein said filter element divides said filtering section between a pressurized side communicated with the outlet side of the recycling pump and a return side communicated with said sump section.

9. Lubricating system as claimed in claim 8, wherein a pressure sensor is responsive to the pressure level in said pressurized side to prevent operation of said recycling pump when the pressure level in the pressurized side exceeds a predetermined level.

10. Lubricating system as claimed in claim 1, wherein said conduit means includes an inlet conduit communicated with said engine for communicating oil to said sump section and an outlet conduit for returning oil from the sump section to said engine, and a deaeration unit in said inlet conduit for preventing foaming of the lubricating oil communicated into said sump section by removing air from the oil communicated through the inlet conduit.

11. Lubricating system as claimed in claim 1, wherein said conduit means includes an inlet conduit communicated with said engine for communicating oil to said sump section and an outlet conduit for returning oil from the sump section to said engine and said transfer pump means includes an inlet transfer pump for forcing oil flow through said inlet conduit and an outlet transfer pump operable independently of said inlet transfer pump for forcing oil through said outlet conduit whereby said outlet transfer pump can be operated when the vehicle ignition system is operated to prelube the engine by transferring lubricating oil from said sump section to said engine before the engine is started.

12. Lubricating system as claimed in claim 1, wherein said housing is split at said dividing means into a pair of components, and clamping means for releasably joining said housing components together.

13. Method of operating an engine lubricating system having a sump remote from said engine including the steps of pumping lubricating oil from said engine to said sump and from said sump to said engine through an oil transfer circuit without filtering the oil as it is pumped through the transfer circuit, and pumping oil from said sump through a recycle circuit separate from said transfer circuit and operable independently thereof from said sump through a filter element and then back to said sump.

14. Method of operating an engine lubricating system as claimed in claim 13, including the step of discontinuing the pumping of lubricating oil through said recycle circuit when said filter element becomes clogged while continuing pumping of lubricating oil through said transfer circuit.

15. Method of operating an engine lubricating system as claimed in claim 13, said sump including an inlet for receiving oil from said transfer circuit and an outlet for returning oil to said transfer circuit for transfer back to said engine, said method including the step of forcing the oil to pass around and/or over one or more baffles as the oil is transferred within said sump from the inlet to the outlet.

16. Method of operating an engine lubricating system as claimed in claim 15, said baffles dividing said sump into at least two compartments, said method including the step of transferring oil from said inlet to said recycle circuit through a common compartment and transferring oil to said outlet through a compartment other than said common compartment.

17. Method of operating an engine lubricating system as claimed in claim 13, including the step of heating the oil in said sump.

18. Method of operating an engine lubricating system as claimed in claim 13, including the step of transferring a quantity of oil in said transfer circuit from said sump to said engine before said engine is started.

19. Method of operating an engine lubricating system as claimed in claim 13, including the step of removing air from the oil communicated through said transfer circuit to prevent foaming of the oil communicated into said sump.

* * * * *